United States Patent [19]

Hirozane

[11] Patent Number: 4,668,074

[45] Date of Patent: May 26, 1987

[54] DEVICE FOR DETECTING THE REMAINING AMOUNT OF DEVELOPER

[75] Inventor: Takashi Hirozane, Tokyo, Japan

[73] Assignee: Ricoh Company, Ltd., Tokyo, Japan

[21] Appl. No.: 749,261

[22] Filed: Jun. 27, 1985

[30] Foreign Application Priority Data

Jun. 29, 1984 [JP] Japan ..... 59-132968

[51] Int. Cl.[4] ..... G03G 15/08

[52] U.S. Cl. ..... 355/14 D; 355/3 DD; 118/689; 222/DIG. 1

[58] Field of Search ..... 355/3 DD, 14 D; 118/689, 690; 222/DIG. 1

[56] References Cited

U.S. PATENT DOCUMENTS 4,456,364 6/1984 Hatzis ..... 355/3 DD 4,592,642 6/1986 Imaizumi et al. ..... 355/14 D

*Primary Examiner*—R. L. Moses

*Attorney, Agent, or Firm*—Oblon, Fisher, Spivak, McClelland & Maier

[57] ABSTRACT

A device for detecting the amount of developer remaining in a developer tank of a developing device is provided. A stirring unit is rotatably provided in the developer tank, and the present detector device is operatively associated with the stirring unit for detecting the level of resistance applied to the stirring unit by the developer inside of the tank. The detector device includes a pair of discs arranged opposite to each other, in which one of the discs is provided freely rotatable i one direction around a center shaft on which the stirring unit is mounted and the other disc is fixedly mounted on the center shaft. A spring is provided to bias one of the pair of discs to rotate with respect to the other and the pair of discs are so structured to cause a relative rotation over a predetermined angle. When the stirring unit experiences a greater level of resistance by the developer, the first and second discs are maintained in a first relative position against the force of the spring; whereas, the first and second discs are set in a second relative position by the force of the spring when the level of resistance encountered by the stirring unit has decreased beyond a predetermined threshold level.

10 Claims, 5 Drawing Figures

DEVICE FOR DETECTING THE REMAINING AMOUNT OF DEVELOPER

BACKGROUND OF THE INVENTION

1. Field of the Invention

This invention relates to a device for detecting the remaining amount of developer stored in a developer tank, and in particular, to such a device for use with a developing device which uses toner particles for developing an electrostatic latent image.

2. Description of the Prior Art

A developing device for developing an electrostatic latent image formed on an image bearing member, such as a photosensitive member, with toner particles is well known in the art. Such a developing device is commonly used in various types of imaging machines, such as electrophotographic copiers and printers, and it typically includes a developer tank for storing therein a quantity of developer. As the development takes place, the developer stored in the developer tank is consumed, so it is necessary to feed the developer into the tank. In order to indicate to the operator that the necessity to replenish developer arises, use has been made of a device for detecting the amount of remaining developer in the tank. Such a prior art detecting device includes a detector coil disposed inside of the developer tank, which changes its inductance depending on the amount of developer remaining in the tank. However, such a prior art device requires the provision of an electrical circuit for processing a signal picked up from the coil, and, thus, it tends to be complicated in structure and high in cost.

SUMMARY OF THE INVENTION

In accordance with the principle of the present invention, there is provided a device, which is primarily mechanical in structure, for detecting the condition that the amount of developer remaining in a reservoir has decreased below a threshold level and thus the developer must be replenished. In the preferred mode of the present invention, the present detector device is provided for detecting the amount of developer stored in a developer tank of a developing device for developing an electrostatic latent image. The developing device includes a developing tank for storing therein a quantity of developer and stirring means rotatably supported in said developing tank for stirring the developer inside of the tank. The present device is provided to detect the level of torque required to rotate the stirring means which is immersed in the developer, and if the level of torque has decreased below a predetermined level due to the consumption of the developer inside of the tank, this state is detected to indicate the necessity of developer replenishment.

It is therefore a primary object of the present invention to obviate the disadvantages of the prior art as described above and to provide an improved device for detecting the amount of remaining developer stored in a reservoir.

Another object of the present invention is to provide an improved device for detecting the condition that the amount of developer remaining in a developer tank has decreased beyond a threshold level.

A further object of the present invention is to provide an improved device for detecting the amount of remaining developer, which is essentially mechanical in structure.

A still further object of the present invention is to provide an improved device for detecting the amount of remaining developer, which is simple in structure and reliable in operation.

Other objects, advantages and novel features of the present invention will become apparent from the following detailed description of the invention when considered in conjunction with the accompanying drawings.

DESCRIPTION OF THE PREFERRED EMBODIMENTS

Figure 1:
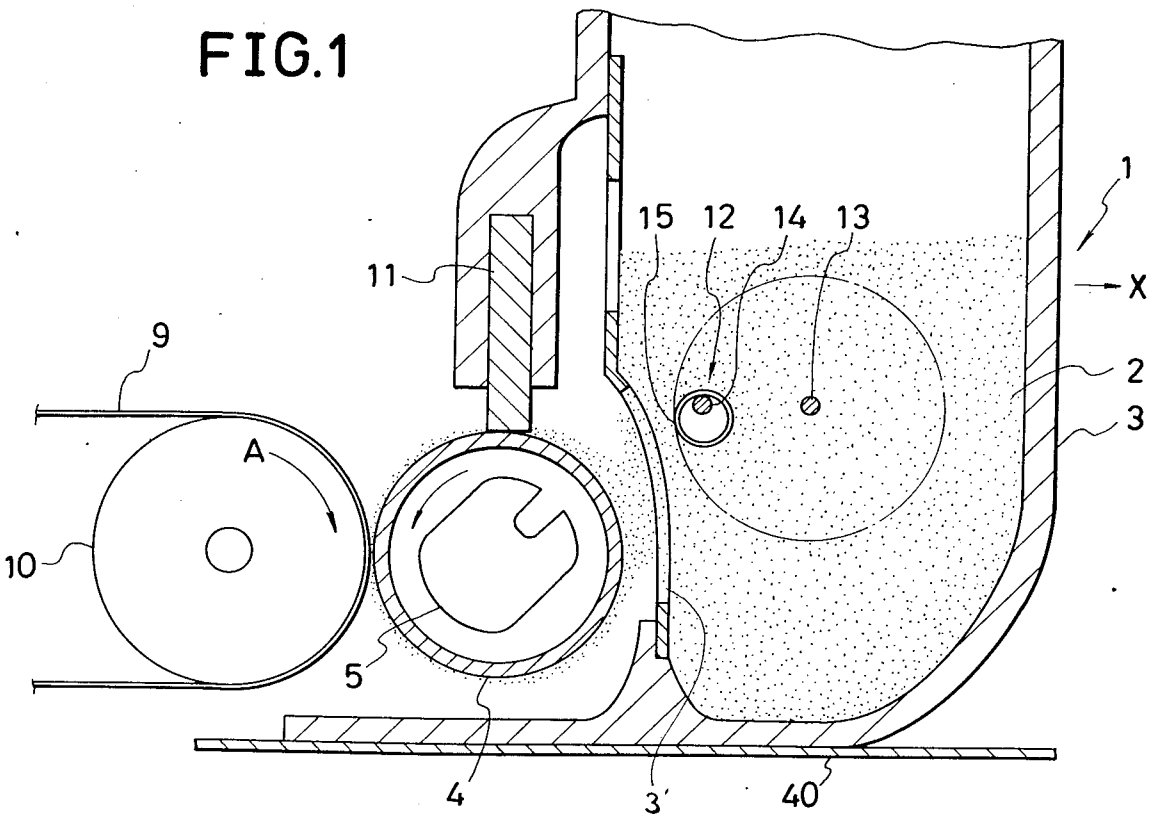
FIG. 1 is a schematic illustration showing the overall structure of a developing device to which the present invention may be advantageously applied.

Referring now to FIG. 1, there is schematically shown a developing device 1 to which the present invention may be advantageously applied. The developing device 1 shown in FIG. 1 defines a part of an imaging machine, such as an electrophotographic copier, and it uses a so-called single component developer which is typically comprised of magnetic material. The developing device includes a developer tank 1 which stores therein a quantity of developer 2, or toner particles including magnetic material in the illustrated example. The developing device 1 also includes a developing roller 4 as rotatably disposed adjacent to a supply opening 3' provided at the bottom of the tank 3. The developing roller 4 is rotatably supported and driven to rotate counterclockwise as indicated by the arrow. Inside the developing roller 4 is disposed a magnet roll 5 which causes the developer 2 supplied from the tank 3 through the opening 3' to be attracted to the outer peripheral surface of the developing roller 4. Thus the developer 2 is transported along a circular path defined by the outer peripheral surface of the developing roller 4 as magnetically attracted thereto.

Figure 2:
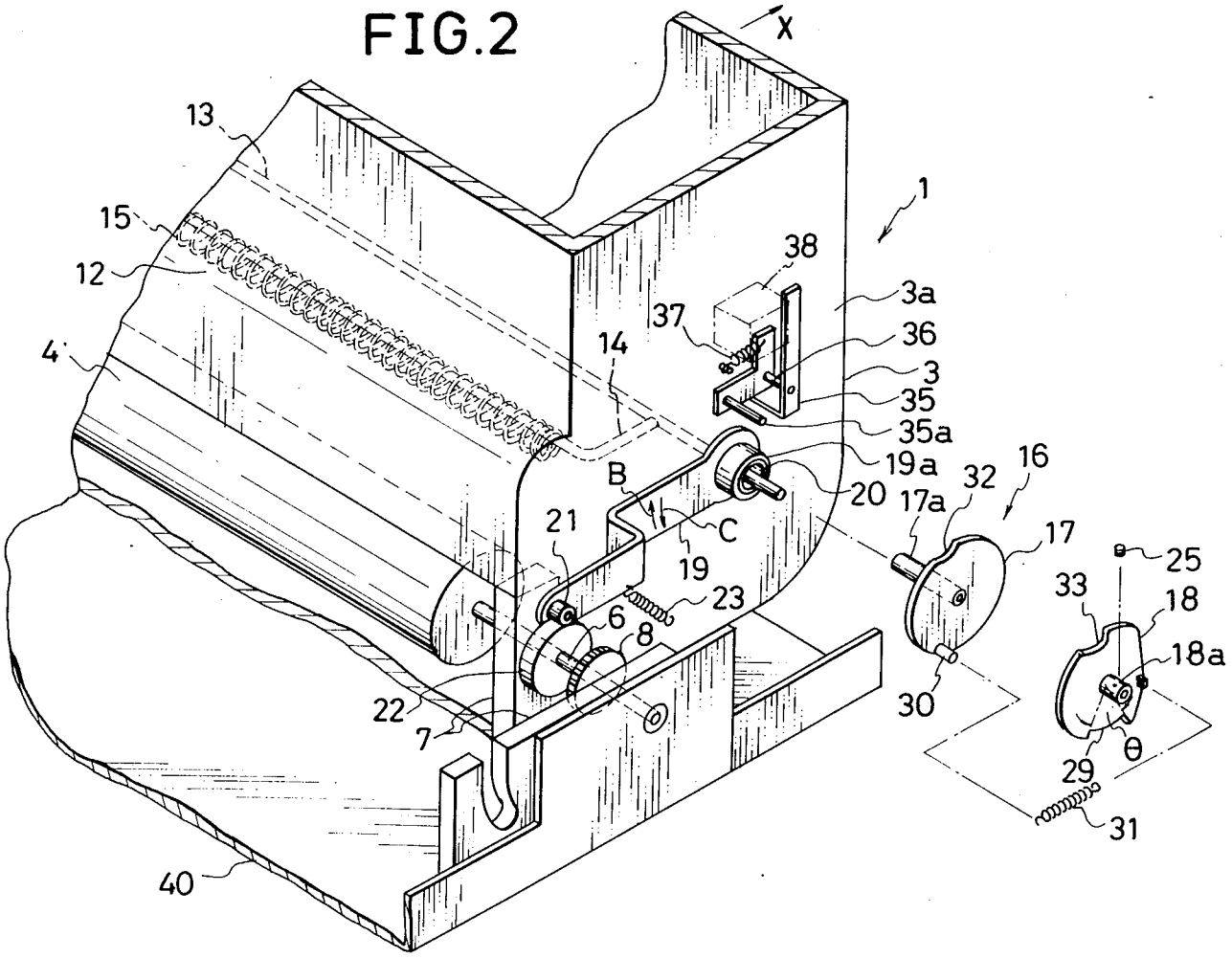
FIG. 2 is an exploded, perspective view showing a device for detecting the amount of remaining developer constructed in accordance with one embodiment of the present invention as mounted on the developing device illustrated in FIG. 1.

As shown in FIG. 2, the developing roller 4 has a support shaft 6 which extends axially from each end surface thereof, and the support shaft 6 is journalled through a support member 7 which is fixedly attached to the tank 3. The support shaft 6 also carries as fixedly attached thereto a gear 8 which is in mesh with a driving gear (not shown) so as to be driven to rotate in a predetermined direction. As will be described in detail later, the support shaft 6 also carries as fixedly attached thereto an eccentric cam 22. It is to be noted that another support shaft (not shown) is provided as extending axially from the opposite end surface of the developing roller 4 and it is also rotatably supported.

As shown in FIG. 1, the developing roller 4 is so disposed to oppose an imaging surface of a photosensitive belt 9 which extends around a roller 10 which, in turn, is driven to rotate in the direction indicated by the arrow A. As well known in the art, various components are disposed along the photosensitive belt 9 for processing an image on the imaging or outer surface of the photosensitive belt 9, though they are not shown for the purpose of brevity. These components, typically, include a corona charger for charging the imaging surface uniformly, an image exposure unit for applying an original light image to the uniformly charged belt 9 to form an electrostatic latent image by selectively dissipating the uniform charge in accordance with the applied light image, which is to be developed by the developing device 1 shown in FIG. 1, an image transfer unit for transferring the developed image to a transfer medium, and a cleaning unit for cleaning the imaging surface of the belt 9 to set ready for the next cycle of imaging operation.

Also provided in the developing device 1 is a blade 11 which is supported by the tank 3 and which has its bottom end in pressure contact with the outer peripheral surface of the developing roller 4. Thus, as the developing roller 4 is driven to rotate in the direction indicated by the arrow, the developer 2 magnetically attracted to the outer peripheral surface of the developing roller 4 by means of magnetic attraction becomes charged to a predetermined polarity due to friction with the blade 11, and, at the same time, the developer 2 attracted to the developing roller 4 becomes regulated in thickness so that there is formed a thin film of uniformly charged developer on the developing roller 4 after moving past the blade 11. The thus formed thin film of developer is then applied to a latent image formed on the belt 9 so that the developer is selectively transferred to the belt 9 to develop the latent image.

As also shown in FIG. 1, a stirring unit 12 is disposed inside of the developer tank 3. Preferably, such a stirring unit 12 is disposed at the bottom of the tank 3 and adjacent to the supply opening 3'. The stirring unit 12 is normally disposed to be immersed in the developer 2 stored inside of the tank 3 so as to prevent the developer 2 from agglomerating and forming clumps. As also illustrated in FIG. 2, the stirring unit 12 includes a center shaft 13 which extends horizontally through the interior of tank 3 and which is rotatably supported by side walls **3*a* of the tank 3. A generally U-shaped arm 14, having a pair of radial sections and a horizontal section, is fixedly attached to the center shaft 13 in the form of an inverted-U shape with respect to the center shaft 13. And, thus, as the center shaft 13 is driven to rotate, the arm 14, in particular its horizontal section, moves around the center shaft 13. The stirring unit 12 further includes a coil 15 which is loosely fitted onto the arm 14, in particular, the horizontal section thereof. Accordingly, as the center shaft 13 is driven to rotate, the coil 15 moves around the center shaft 13 approximately in a circular path as indicated by the one-dotted line in FIG. 1 so that the developer 2 stored inside of the tank 3 becomes stirred thereby allowing to prevent the developer 2 from becoming clumpy. It should thus be noted that the center shaft 13 requires a certain level of torque to be applied so as to rotate within the developer 2 because the developer 2 itself presents a resistance against the rotational movement of the center shaft 13 or stirring coil 15. Although not shown specifically, the other end of the center shaft 13 is also rotatably supported by a side wall of the tank 3**.

As shown in FIG. 2, a remaining developer detecting device 16 constructed in accordance with one embodiment of the present invention is provided as attached to the tank 3. As described previously, as the development takes place, the developer 2 stored inside of the tank 3 is consumed gradually and when the amount of the developer 3 remaining inside of the tank 3 has reached a predetermined level, this condition is detected by the present detecting device 16 and a warning signal is produced to apprise the operator of the neccessity of developer replenishment. As will be made clear later, it will be appreciated that in accordance with the principle of the present invention, a decrease in the amount of developer 2 inside of the tank 3 beyond a predetermined level is detected by a change in torque to rotate the stirring coil 15 or center shaft 13.

Figure 3:
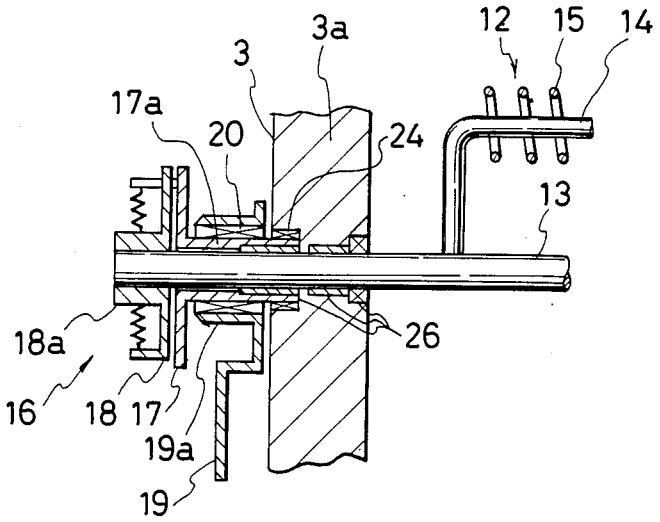
FIG. 3 is a cross-sectional view showing the device for detecting the amount of remaining developer when assembled.

In the illustrated embodiment, the detector device 16 includes a first disc 17, a second disc 18 and a rocking lever 19. As also shown in FIG. 3, the first disc 17 is provided with a boss section **17*a* which is loosely and rotatably fitted onto that portion of the center shaft 13 which extends outside of the tank 3. As best shown in FIG. 3, a one-way clutch 20 is mounted on the boss section 17*a* of the first disc 17, and the rocking lever 19 has its base end 19*a* supported by the one-way clutch 20. On the other hand, the rocking lever 19 has a free end at which a follower roller 21 is rotatably supported. The follower roller 21 rests on a peripheral surface of the cam 22 in rolling contact therewith. Since there is also provided a spring 23 having its one end fixedly attached to the side wall 3*a* and its other end fixedly attached to the rocking lever 19, the follower roller 21 is normally in pressure contact with the cam 22. Accordingly, as the cam 22 rotates together with the developing roller 4, the rocking lever 19 executes a rocking movement back and forth as indicated by the arrows B and C. It should thus be understood that the outer peripheral surface of the cam 22 is eccentric with respect to the rotating axis of the developing roller 4 or cam 22**.

However, as shown in FIG. 3, since the base end **19*a* of the rocking lever 19 is mounted on the one-way clutch 20, only the rocking motion in the clockwise direction as indicated by the arrow B is transmitted to the first disc 17 and the other rocking movement in the counterclockwise direction indicated by the arrow C is not transmitted to the first disc 17. Thus, when the rocking lever 19 rotates in the direction indicated by the arrow B, the first disc 17 also rotates in the same direction in association therewith; however, when the rocking lever 19 rotates in the opposite direction indicated by the arrow C, the first disc 17 remains stationary and is not set in rotation. Besides, it is to be noted that another one-way clutch 24 is provided between the boss section 17*a* of the first disc 17 and the side wall 3*a* of the tank 3 so as to positively prevent the first disc 17 from rotating in the counterclockwise direction indicated by the arrow C. With this structure, the first disc 17 is secured to rotate only in the clockwise direction indicated by the arrow B when the rocking lever 19** rotates in the same direction.

The second disc 18 is disposed in parallel with the first disc 17 as best shown in FIG. 3, and the second disc 18 also includes a boss section **18*a* which is fitted onto the end portion of the center shaft 13 and fixed thereto by means of a set screw 25 as indicated in FIG. 2. As a result, the second disc 18 is integral with the center shaft 13 and thus rotates in unison therewith. Also shown in FIG. 3 are several bearings 26** for rotatably supporting the associated elements.

Figure 4:
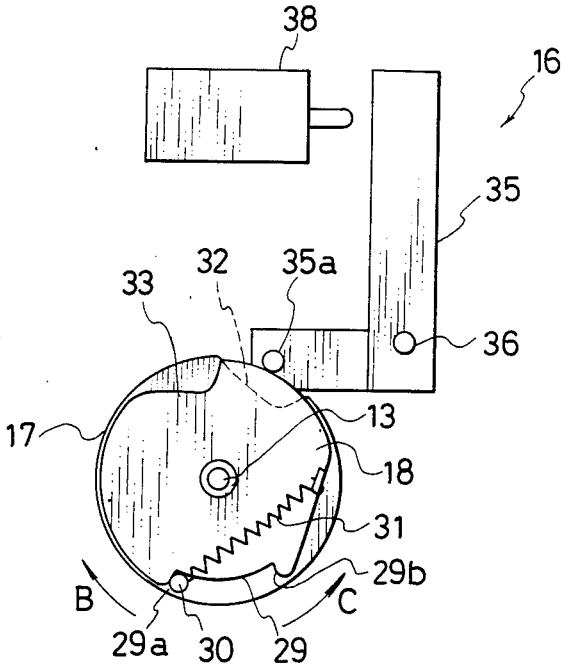
FIGS. 4 and 5 are schematic illustrations which are useful for explaining the operation of the present device for detecting the amount of remaining developer.

As best shown in FIGS. 2 and 4, the second disc 18 is formed with a circumferential recess 29 extending along its periphery over a predetermined angle $\theta$. On the other hand, a pin 30 is planted in the first disc 17 and the pin 30 is received in the circumferential recess 29 when the first and second discs 17 and 18 are assembled. Accordingly, the first disc 17 may rotate relative to the second disc 18 over a predetermined $\theta$ and the relative rotation beyond this angle is prohibited. Also provided is a spring 31 which has its one end engaged with the pin 30 planed in the first disc 17 and its other end fixedly attached to the second disc 18 so that the second disc 18 is normally biased to rotate in the clockwise direction indicated by the arrow B with respect to the first disc 17.

The first and second discs 17 and 18 are formed with profiled notches 32 and 33, respectively. It is to be noted that these profiled notches 32 and 33 are out of alignment when the pin 30 of the first disc 17 is set in engagement with the left end of the circumferential recess 29, which corresponds to the condition shown in FIG. 4; on the other hand, these profiled notches 32 and 33 are set in alignment when the pin 30 of the first disc 17 is in engagement with the right end of the circumferential recess 29, which corresponds to the condition shown in FIG. 5.

Also provided as planted in the side wall 3*a* of the tank 3 is a support pin 36 which rotatably supports an actuator unit 35 for actuating a switch 38 mounted on a main frame (not shown). The actuator unit 35 has an acutator pin 35*a* as planted therein and it is normally biased to rotate counterclockwise around the support pin 36 by means of a spring 37 extending between the actuator unit 35 and the side wall 3*a*. Since the atuator unit 35 is normally biased to rotate counterclockwise around the support pin 36, its actuator pin 35*a* is pressed against the peripheral surface of at least either one of the first and second discs 17 and 18. Alternatively, a roller may be rotatably mounted on the acutator pin 35*a* such that the roller is in rolling contact with the peripheral surfaces of the first and second discs 17 and 18.

In operation, as the developing roller 4 is driven to rotate in a predetermined direction, the cam 22 is also set in rotation, and, thus, the rocking lever 19 is set in reciprocating pivotal motion around the center shaft 13 through the rolling contact between the roller 21 and the cam 22. While the rocking lever 19 pivots back and forth as indicated by the arrows B and C, the first disc 17 is caused to rotate intermittently in the clockwise direction only when the rocking lever 19 pivots in the direction B. This clockwise rotation of the first disc 17 is transmitted to the second disc 18, so that the center shaft 13 and thus the stirring unit 12 are also set in clockwise rotation indicated by the arrow B intermittently. Since the stirring unit 12 is rotated around the center shaft 13 intermittently in the clockwise direction indicated by the arrow B, the developer 2 stored inside of the tank 3 may be stirred properly.

Under the circumstances, if a relatively large amount of developer 2 is stored in the tank 3, the developer 2 in the tank 3 presents a relatively large resistance against the movement of the stirring unit 12, so that the relative positional relation between the first and second discs 17 and 18 is such that the pin 30 of the first disc 17 is in engagement with the left end 29*a* of the circumferential recess 29 formed in the second disc 18. Through this engagement, the pin 30 pushes the left end 29*a* so that the second disc 18 and thus the center shaft 13, together with the stirring unit 12, are rotated in the clockwise direction indicated by the arrow B. In this instance, the spring 31 is maintained in its maximum tension. On the other hand, when the rocking lever 19 pivots in the counterclockwise direction indicated by the arrow C, the rocking lever 19 does not apply a driving force to the first disc 17 because of the provision of the one-way clutch 20. Besides, the first disc 17 is positively prevented from rotating in the counterclockwise direction indicated by the arrow C due to the other one-way clutch 24, the first disc 17 does not rotate in the direction C under the force of the spring 31. The second disc 18 also remains stationary in this instance because the resistance applied to the stirring unit 12 by the developer 2 stored in the tank 3 is sufficiently large. As a result, the first and second discs 17 and 18 maintain the relative positional relation illustrated in FIG. 4. For convenience, this condition will be termed as a first relative position between the first and second discs 17 and 18. It should be understood that the second disc 18 is not rotated with respect to the first disc 17 even if a force is applied between the first and second discs 17 and 18 by the spring 31 because the first disc 17 is prevented from rotating counterclockwise by the provision of the one-way clutch 24 and the second disc 18, which is integrally connected to the center shaft 13 and to the stirring unit 12, is prevented from rotating clockwise due to the resistance applied to the stirring unit 12 by the developer 12 inside the tank 3. As long as the first relative position is maintained as illustrated in FIG. 4, the profiled notches 32 and 33 formed in the first and second discs 17 and 18, respectively, are not aligned axially, so that the actuator pin 25*a* is in engagement with the outermost periphery of at least either one of the first and second discs 17 and 18 (second disc 18 in the illustrated example) thereby maintaining the switch 38 off.

Figure 5:
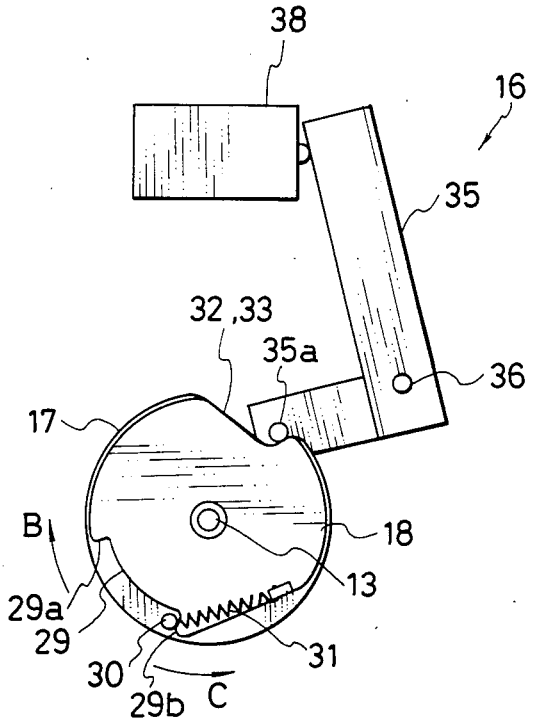

As the development proceeds, the developer 2 inside of the tank 3 is gradually consumed and its amount decreases below a predetermined threshold. If this happens, the resistance applied to the stirring unit 12 by the developer 2 is decreased below a threshold level so that the stirring unit 12 and thus the second disc 18 is now allowed to rotate clockwise in the direction indicated by the arrow B with respect to the first disc 17. This will be easily understood when reference is made to FIG. 1. That is, if the developer 2 inside of the tank 3 has decreased close to or even below the topmost portion of the circular path of the stirring unit 12 indicated by the one-dotted line, then the resistance applied to the stirring unit 12 by the developer 2 is substantially lower so that the the center shaft 13 and thus the second disc 18 will be allowed to rotate clockwise under the recovery force of the spring 31. If this occurs, the second disc 18 rotates over the angle $\theta$ until the right end 29*b* of the circumferential recess 29 formed in the second disc 18 comes into engagement with the pin 30 planted in the first disc 17, as shown in FIG. 5. This condition will be termed as a second relative position between the first and second discs 17 and 18 for convenience.

As shown in FIG. 5, when the second relative position is established with the right end 29*b* in engagement with the pin 30, the profiled notches 32 and 33 of the first and second discs 17 and 18, respectively, are aligned axially, and, as a result, the actuator pin 35*a* moves into the lowest position of the aligned notches 32 and 33 under the recovery force of the spring 37. This then causes the actuator unit 35 to rotate around the support pin 36 counterclockwise whereby the switch 38 is turned on by the actuator unit 35. The switch 38 then sends a signal which may be used to activate a warning unit for warning the operator as to the necessity of developer replenishment. Any scheme of warning may be used. For example, a warning lamp may be provided to give a visual warning, or, alternatively, a buzzer may be activated to give an audio warning. If the operator fills the tank 3 with fresh developer, the stirring unit 12 again begins to experience an increased resistance so that the second disc 2 remains stationary while the first disc 17 continues to rotate clockwise intermittently due to the pivotal motion of the rocking lever 19 until the first relative position shown in FIG. 4 is reestablished. When this first relative position is reestablished, the actuator unit 35 is rotated clockwise around the support pin 36 to have the switch 38 turned off.

It is to be noted that the switch 38 may be mechanical as illustrated or opto-electrical. In the illustrated embodiment, the switch 38 was mounted on the main frame of an imaging machine (not shown); however, it may also be mounted on other parts, such as the developer tank 3. It is to be noted, however, that the following advantages accrue when the switch 38 is mounted on the main frame of imaging machine. That is, it is often so constructed that the developing device 1 is detachably mounted in the imaging machine whereby the developing device 1 may be detached from the imaging machine, together with a bottom support plate 40 on which the developing device 1 is mounted, as pulled in the direction indicated by the arrow X at the time of developer replenishment and/or maintenance of the developing device 1. In such a case, if the switch 38 is mounted on the main frame of imaging machine, the switch 38 may be left mounted on the main frame even when the developing device 1 is pulled out. This is advantageous, because electrical wiring to the switch 38 can be left intact. On the other hand, if the switch 38 is mounted on the developing device 1, e.g., on its tank 3, then the electrical wiring to the switch 38 must be disconnected, and, thus, for this purpose, a suitable connector must be provided.

In the above-described embodiment, the rocking lever 19 is set in rocking motion due to the rotation of the developing roller 4. However, the rocking lever 19 may also be set in motion by any other scheme. For example, if the magnet roll 5 disposed inside of the developing roller 4, then it may be so structured that the rocking lever 19 is set in motion in association with the rotation of the magnet roll 5 easily by one skilled in the art in view of the above-described teachings. Furthermore, in the above-described embodiment, a pin and recess combination was used between the first and second discs 17 and 18 for limiting the relative rotational motion; however, any other structure obvious to one skilled in the art may also be applied to limit the relative rotation between the first and second discs 17 and 18. It should also be noted that the threshold in the amount of the developer 2 remaining in the tank 3 can be advantageously determined by appropriately selecting the spring constant for the spring 31. Moreover, in the above-described embodiment, the actuator unit 35 was mounted on the developer tank 3, but this can also be provided as mounted on the main frame of imaging machine.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A device for detecting the amount of remaining developer stored inside of a reservoir in which stirring means for stirring said developer is supported to be rotatable around a center shaft, comprising:

rocking means operatively connected to said center shaft, said rocking means being set in pivotal motion at least during a developing operation thereby transmitting the rotational force to said center shaft only when said rocking means pivots in a predetermined direction;

detecting means operatively connected to said center shaft for detecting the level of resistance applied to said stirring means by said developer against the rotational motion of said stirring means around said center shaft, said detecting means being capable of detecting a first state indicating said resistance to be above a predetermined threshold level and a second state, indicating said resistance to be equal to or below said threshold level; and actuating means operatively associated with said detecting means for actuating a switch only when said detecting means has detected said second state.

2. The device of claim 1 wherein said detecting means includes a first disc loosely fitted onto said center shaft and insured to rotate only in a predetermined first direction, a second disc disposed adjacent to said first disc as opposed thereto as fixedly mounted on said center shaft, relative rotation limiting means for limiting the relative rotational motion between said first and second discs over a predetermined angle, and first biasing means for biasing one of said first and second discs to rotate in a predetermined direction with respect to the other.

3. The device of claim 2 wherein said first disc is provided with a boss section through which said center shaft extends with a gap therebetween, said boss section of said first disc is connected to a first one-way which is mounted on a wall defining said reservoir.

4. The device of claim 3 further comprising a second one-way clutch mounted on said boss section of said first disc, wherein said rocking means has one end coupled to said second one-way clutch thereby allowing said rocking means to transmit the rotational force to said first disc only when said rocking means pivots in said predetermined direction.

5. The device of claim 4 wherein said rocking means includes a rocking lever having a base end coupled to said second one-way clutch and a free end provided with a rotatable roller which is in rolling contact under pressure with a peripheral surface of a cam which is driven to rotate in a predetermined direction.

6. The device of claim 5 further comprising second biasing means for biasing said rocking lever so as to be normally pressed against the peripheral surface of said cam.

7. The device of claim 6 wherein said cam is fixedly mounted on a support shaft which supports a developing roller.

8. The device of claim 3 wherein said relative rotation limiting means includes a first pin planted in one of said first and second discs and a recess formed extending at least circumferentially in the other of said first and second discs so as to receive said first pin therein thereby limiting the relative rotation between said first and second discs to a predetermined range between a first relative position and a second relative position.

9. The device of claim 8 wherein said first and second discs are provided with first and second notches, respectively, whereby said first and second notches are not aligned axially when said first and second discs are set in said first relative position and are aligned axially when said first ands second disc are set in said second relative position.

10. The device of claim 9 wherein said actuating means includes a second pin which is normally pressed against the periphery of at least one of said first and second discs, whereby when said first and second notches are not aligned, said second pin maintains a predetermined distance from said center shaft as determined by the diameter of said first and second discs; whereas, when said first and second notches are aligned, said second pin moves closer to said center shaft when it moves into the aligned notches thereby causing said switch to be operated.

* * * * *